US006915643B2

(12) United States Patent
Fukumoto et al.

(10) Patent No.: US 6,915,643 B2
(45) Date of Patent: Jul. 12, 2005

(54) METHOD AND SYSTEM FOR MAKING ICE BY UNDERWATER SUPERCOOLING RELEASE AND LOW TEMPERATURE WATER SUPPLY SYSTEM COMPRISING IT

(75) Inventors: Hiromichi Fukumoto, Koto-ku (JP); Shinji Fukamura, Koto-ku (JP); Hideki Shudai, Koto-ku (JP); Akito Machida, Koto-ku (JP)

(73) Assignees: The Kansai Electric Power Co., Inc., Osaka (JP); Mayekawa Mfg. Co., Ltd., Tokyo (JP)

( * ) Notice: Subject to any disclaimer, the term of this patent is extended or adjusted under 35 U.S.C. 154(b) by 0 days.

(21) Appl. No.: 10/490,612

(22) PCT Filed: Apr. 5, 2002

(86) PCT No.: PCT/JP02/03429

§ 371 (c)(1),
(2), (4) Date: Jul. 9, 2004

(87) PCT Pub. No.: WO03/031887

PCT Pub. Date: Apr. 17, 2003

(65) Prior Publication Data

US 2004/0231343 A1 Nov. 25, 2004

(30) Foreign Application Priority Data

Sep. 26, 2001 (JP) ..... 2001-294346

(51) Int. Cl.[7] ..... F25C 1/00
(52) U.S. Cl. ..... 62/66; 62/74; 62/340
(58) Field of Search ..... 62/66–74, 340–356

(56) References Cited

U.S. PATENT DOCUMENTS 4,261,182 A * 4/1981 Elliott ..... 62/353
5,829,257 A * 11/1998 Newman et al. ..... 62/73
5,931,003 A * 8/1999 Newman et al. ..... 62/74
6,125,639 A * 10/2000 Newman et al. ..... 62/74
6,158,228 A * 12/2000 Nakamura et al. ..... 62/74

* cited by examiner

*Primary Examiner*—William E. Tapolcai
(74) *Attorney, Agent, or Firm*—Crowell & Moring LLP

(57) ABSTRACT

The ice making system by supercooling release comprises an ice thermal storage tank, a residual supercooled water generating section, and a complete releasing section. The complete releasing section and ice thermal storage tank are connected with an ice water line. Further, the ice thermal storage tank and residual supercooled water generating section are connected with a water line. The residual supercooled water generating section is supplied with water from the ice thermal storage tank to generate supercooled water, which is released from the supercooled state, ice and residual supercooled water being produced thereby. The residual supercooled water is completely released from supercooled state in the complete releasing section. The complete releasing is performed in the manner, in which the mixture containing the residual supercooled water and generated ice nuclei is spout into an erect, cylindrical container from its bottom part to generate a spiraling flow or vortex flow therein, and supercooling release of said residual supercooled water is achieved by the increased frequency of contact between said residual supercooled water and said ice nuclei through the agitation of said mixture due to said vortex flow, which continues until the flow is pushed out from the outlet provided in the upper portion of said erect, cylindrical container.

9 Claims, 4 Drawing Sheets

METHOD AND SYSTEM FOR MAKING ICE BY UNDERWATER SUPERCOOLING RELEASE AND LOW TEMPERATURE WATER SUPPLY SYSTEM COMPRISING IT

TECHNICAL FIELD

The present invention relates to a method and system for making ice by releasing continuously under water the supercooled state of supercooled water and a low temperature water supply system using said ice making system.

BACKGROUND OF THE INVENTION

Generally, when making ice by underwater supercooling release, if a so-called residual supercooled state exists in which ice is mingled in supercooled water and the residual supercooled state is transferred downstream while kept in the supercooled state, ice adheres to the wall of the flow channel extending downstream from a supercooling releasing section to an ice thermal storage tank, and it may happen that the flow channel is clogged due to the growth of the adhered ice.

That is, the growth of the ice adhered to the wall of the flow channel is fostered by the contact with the ambient supercooled water.

As the adhesion of the ice crystal grown on the wall where the flow velocity is small is strong and the adhered ice is difficult to be separated, ice adheres all over the wall and the flow channel becomes narrowed if such a state continues for a long period.

Further, significantly high pressure is needed to separate the ice grown on the wall, and in addition, sherbet-like ice becomes consolidated due to the force of flow resistance, and finally the pipe conduit(flow channel) may be completely clogged. Therefore, when making ice by underwater supercooling release, it is necessary to prevent the clogging in the downstream pipe conduit by releasing residual supercooled state.

A method of releasing residual supercooled state is disclosed, for example, in Japanese Patent Application Publication No. 5-149653 (hereafter referred to as the example of prior art).

In the example of prior art, as shown in FIG. 1, a completing section of supercooling release is provided downstream after supercooling is released. For example, in FIG. 1(*a*), a throttling section 110 is provided downstream of a underwater supercooling releasing section 108, further an enlargement section 109*a* and a tapered section 109*b* for throttling the flow area to that of the throttling section 110 are provided downstream of the throttling section 110. The throttling section 110, enlargement section 109*a*, and tapered section 109*b* compose the completion section of supercooling release.

In the completion section of supercooling release shown in FIG. 1(*a*), complete release of supercooling is enhanced by the agitation generated as a result of abrupt enlargement of water flow section area after the water passes through the supercooling releasing section.

In the completion section of supercooling release shown in FIG. 1(*b*), a plurality of enlargement section 109*a*1 and 109*a*2 are provided after the throttling section 110. In the completion section of supercooling release shown in FIG. 1(*c*), an impingement member 109*c* is located in the center of the enlargement section 109*a* for generating a turbulent flow.

As described above, in the example of prior art, a turbulent flow is generated in the downstream flow channel to release the residual supercooled state by the agitation induced by the turbulence.

However, it is necessary, in the example of prior art, to provide at least a throttling section, enlargement section, and tapered section. As a result, a problem is encountered that not only the downstream piping must inevitably be long but the ice making apparatus becomes large and complicated.

Further, in the example of prior art, the residual supercooled state is released only by the agitation induced by flow turbulence, so that the residual supercooled state can not be released enough and as a result clogging may occur in the pipe conduit.

DISCLOSURE OF THE INVENTION

An object of the present invention is to provide a method and system of making ice by underwater supercooling release capable of preventing the clogging in pipe conduit through releasing the residual supercooled state with a compact construction.

Another object of the present invention is to provide a low temperature water supply system using said ice making system.

The present invention proposes a method of making ice by underwater supercooling release by supplying supercooled water to a closed vessel and also supplying through a sub-flow line sub-flow water containing seed ice to said closed vessel and releasing the supercooled state of said supercooled water under water, wherein are provided a first step for generating vortex flow spiraling in an erect, cylindrical container by spouting from the bottom part of said container a mixture containing residual supercooled water after said supercooling release and the ice nuclei generated by said releasing, and a second step for achieving supercooling release of said residual supercooled water by increasing the frequency of contact between said residual supercooled water and said ice nuclei through the agitation of said mixture caused by said vortex flow which continues until the flow is pushed out from the outlet provided in the upper portion of said erect, cylindrical container.

Further, according to the invention, said cylindrical container is connected to said closed vessel with a bypass flow passage, and a third step is provided for freshly generating ice nuclei in said residual supercooled water through an ice nuclei generating means attached to said bypass flow passage and circulating them to said closed vessel.

The present invention proposes a system for making ice by underwater supercooling release by supplying supercooled water to a closed vessel and also supplying through a sub-flow line sub-flow water containing seed ice to said closed vessel and releasing the supercooled state of said supercooled water under water, wherein an erect, cylindrical container is provided into which the mixture from said closed vessel containing residual supercooled water and generated ice nuclei is flowed from the bottom part thereof with predetermined velocity in the direction tangential to the circumference of the cylindrical container to generate a spiraling flow therein, and an outlet, which also serves as an air bleeder, for discharging nuclei is provided in the upper portion of the erect, cylindrical container.

In said system, said cylindrical container has a conically shaped outlet forming an outlet and air bleeder in the upper portion thereof, and the volume of the erect, cylindrical container is variable in accordance with the rate of supercooling of said residual supercooled water.

Further, according to the invention, a bypass passage is provided between said erect, cylindrical container and said closed vessel, and an inducing mechanism is located in said bypass passage for enhancing supercooling release.

Said inducing unit is provided with an automatic throttle valve mechanism for generating rapid pressure fluctuation for the supercooled water circulated through said bypass passage.

The ice making system according to the invention is provided with an ice thermal storage tank for storing said generated ice, and a low temperature water supply system is constructed by using the ice making system.

That is, according to the invention, a low temperature water supply system can be obtained, which comprises said ice making system, a circulation line connected to said ice thermal storage tank for circulating water, and a secondary heat exchanger or exchangers connected to the circulation line, a load or loads being connected to said secondary heat exchanger or exchangers.

Further, according to the invention, a low temperature water supply system can be composed, which comprises said ice making system, a feed line of cold water connected to said ice thermal storage tank, and a water supply mechanism for supplying water to said ice thermal storage tank, a load or loads being connected to said secondary heat exchanger or exchangers.

DETAILED DESCRIPTION OF THE PREFERRED EMBODIMENT

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
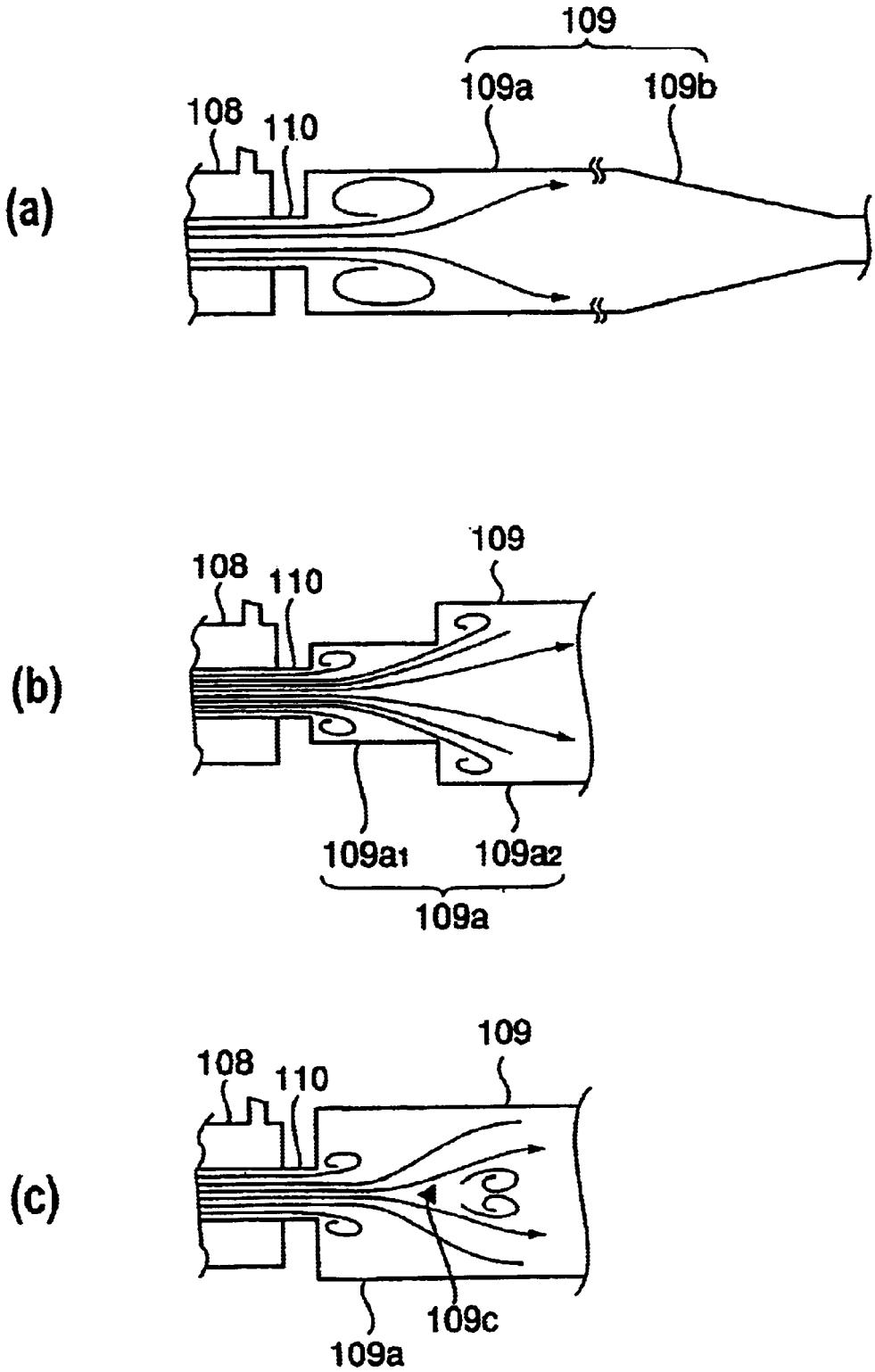
Fig.1 PRIOR ART
FIG. 1 is a representation for explaining the construction of the complete releasing section of supercooling used in a ice making system of prior art.
Figure 2:
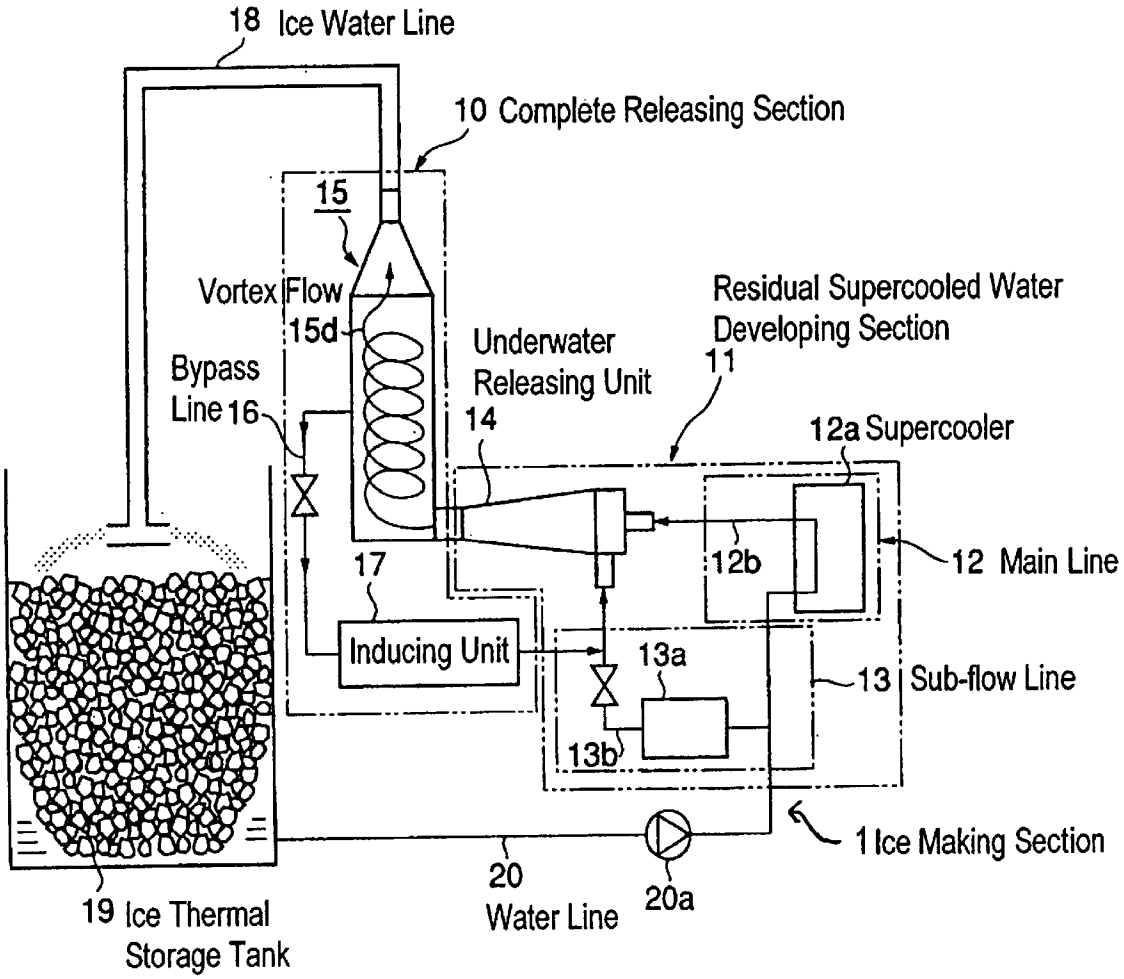
FIG. 2 is a representation showing an example of the ice making system of the present invention.

Referring to FIG. 2, the ice making system employs underwater supercooling release. The system comprises an ice thermal storage tank 19 for storing the ice produced in the system, a residual supercooled water developing section 11 in which the water supplied from the ice thermal storage tank 19 is supercooled and residual supercooled water is caused to be developed when ice is generated by underwater supercooling release of said supercooled water, a complete releasing section 10 for effecting complete releasing of the residual supercooled water, an ice water line 18 which connects said complete releasing section 10 to said ice thermal storage tank 19, and a water line 20 which connects the ice thermal storage tank 19 to the residual supercooled water developing section 11 and is equipped with a pump 20*a*. In the drawing, ice making section 1 indicates constituent elements other than the ice thermal storage tank 19.

The residual supercooled water developing section 11 includes a main line 12, an underwater releasing unit 14, and a sub-flow line 13. Water to be supercooled is supplied from the ice thermal storage tank 19 to the main line 12 by the pump 20*a* through the water line 20 which is provided with a preheater(not shown in the drawing) for melting the ice mixing in the water. In the main line 12, the water to be supercooled is introduced into a supercooler 12*a* with solid matter mixing in the water removed through a filter(not shown in the drawing) and supercooled water is generated therein. The supercooled water is sent through a main flow passage 12*b* to the underwater releasing unit 14 where underwater supercooling release of the supercooled water is performed.

The underwater releasing unit 14 is a closed vessel. It receives the supercooled water from the main line 12 and also receives sub-flow water containing seed ice from the sub-flow line 13 having a seed ice generating section 13*a* and a sub-flow passage 13*b* to achieve underwater supercooling release of the supercooled water. The residual mixture, which contains residual supercooled water not completely released and ice generated by supercooling release, is sent to the complete releasing section 10.

By the way, if the residual supercooled water not completely released is supplied from the underwater releasing unit 14 directly to the ice thermal storage tank 19, it may happen that ice adheres to the wall of the flow passage downstream of the underwater releasing unit 14 toward the ice thermal storage tank 19 and the downstream passage is clogged by the growth of adhered ice. Further, if residual supercooled water maintaining supercooled state is returned to the ice thermal storage tank 19 and reflowed again to the heat exchanger 12*a* for generating supercooled water, freezing may happen in the heat exchanger.

The complete releasing section 10 is provided between the underwater releasing unit 14 and the ice thermal storage tank 19 via a ice water line 18.

Figure 3:
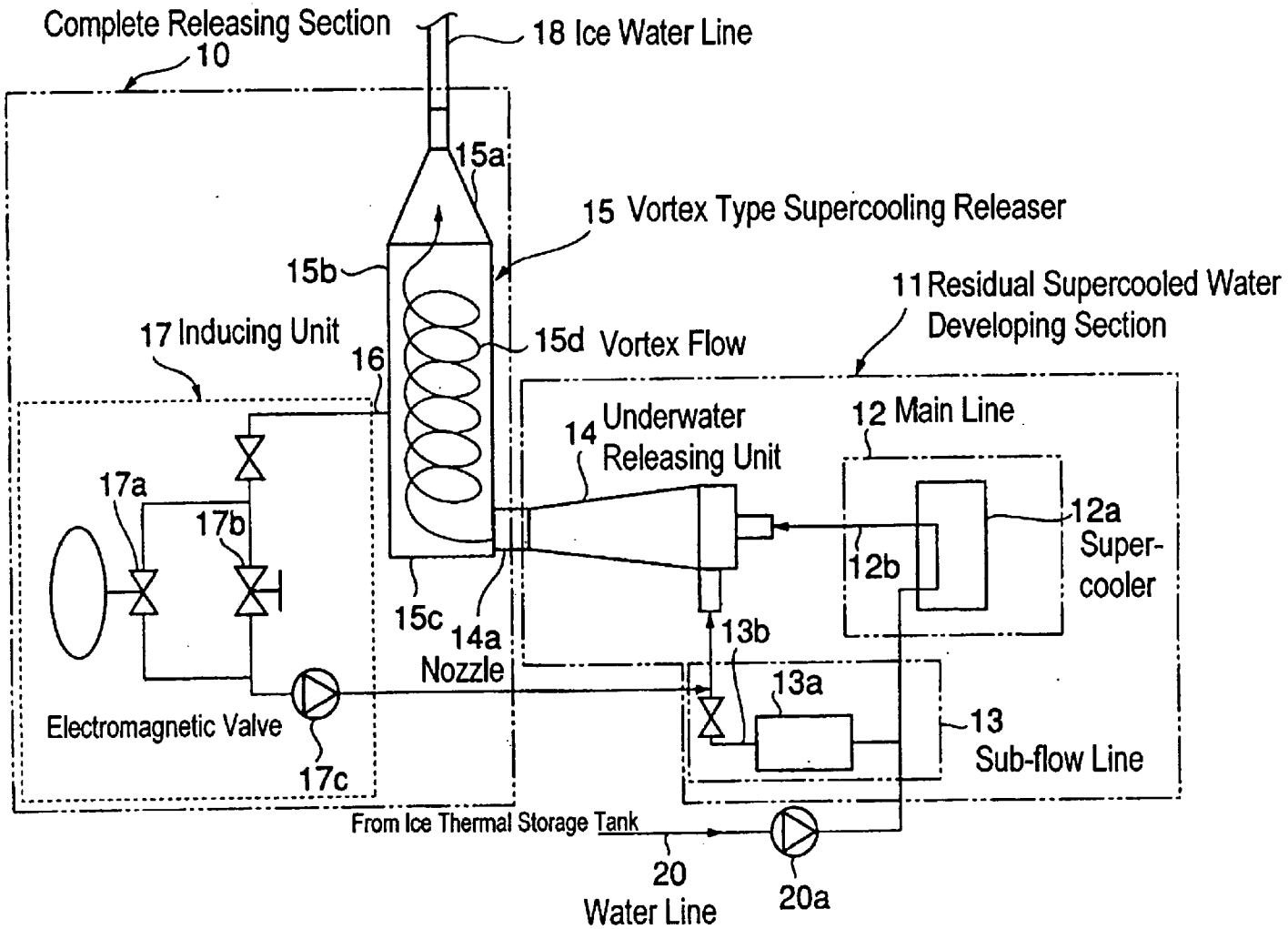
FIG. 3 is a representation for explaining the construction of the inducing unit shown in FIG. 2.

As shown in FIG. 2 and FIG. 3, the complete releasing section 10 comprises a vortex type supercooling releaser 15, an inducing unit 17, and a bypass line 16.

Referring to FIG. 3, the vortex type supercooling releaser 15 is composed of an erect, cylindrical container 15*b* having an upper conical part 15*a* provided with an outlet and air bleeder and provided with an inlet directed tangential to the circumference in its bottom portion 15*c*.

A nozzle 14*a* which forms outlet of the horizontally located underwater releasing unit 14 is connected to said inlet. From the nozzle 14*a* is spouted the residual mixture mentioned above.

A spiral flow is generated in the erect, cylindrical container 15*b* by said spout and vortex flow 15*d* is formed.

The introduced residual mixture of residual supercooled water and ice nuclei is agitated by the vortex flow 15*d*, and the nuclei of which the density is smaller than the supercooled water gather toward the center of the cylindrical container and form an ascending vortex flow.

The residual supercooled water contacts frequently with the nuclei in said process, and if some nuclei adhere to the wall surface, they are not consolidated thereon but separated therefrom because of the large sectional area of flow and considerable high flow velocity near the wall surface owing to the vortex flow. Therefore, the supercooling release of the residual supercooled water in the mixture can be effected.

At the time when the nuclei reach the outlet in the upper portion, the supercooled water accompanying the nuclei is completely released from supercooled state.

The upper conical part 15*a* is shaped conical so that the vortex flow continues to the upper portion.

According to the construction as mentioned above, not only the velocity of ascending of the nuclei by the vortex flow 15*d* can be determined by the velocity of the flow from the nozzle 14*a* of the underwater releasing unit 14 and the sectional area of the cylindrical container, but also the residence period from the time the nuclei entered at the inlet reach the outlet in the upper portion can be determined so that it complies with the rate of supercooling of the residual supercooled water, that means the residence period can be uniquely determined.

After the manner like this, complete releasing of residual supercooled water can be achieved by providing an erect, cylindrical container of suitable dimensions.

The inducing unit 17 is supplied with a part of the supercooled water from the vortex type releasing section 15 through the bypass line 16. Ice nuclei are generated in said inducing unit 17 and the ice nuclei are circulated to the underwater releasing unit 14 together with the supercooled water. Herewith, the releasing of supercooling is enhanced and fluctuation in the rate of supercooling is dealt with.

As shown in the drawings, the inducing unit 17 comprises a throttle valve 17*b*, an electromagnetic valve 17*a*, a flow passage connecting said valves in parallel, and a feed pump 17*c*.

Inducing is done depending on the water temperature at the outlet of the supercooler 12*a* by directly measuring it. When predetermined temperature (for example, a temperature lower than about 0.3° C.) is detected, the flow in the sub-flow line 13 is shut down, bypass line 16 is opened, and feed pump 17*c* is activated. Herewith, the supercooled water is bypassed through the bypass line 16 to be flowed into the underwater releasing unit 14. However, supercooling release can not be induced by the activation of the pump 17*c* only. In this case, said electromagnetic valve 17*a* is activated to reiterate opening and closing with a predetermined period (constant period) for supercooling releasing. Through this operation, the flow rate through the throttle valve 17*b*, which is adjusted by the opening of the valve, is rapidly varied every time the valve is opened and closed, so large, rapid pressure fluctuation is generated in the inlet side of the feed pump 17*c*. As a result, the supercooled state is released and ice nuclei are generated. The generated nuclei are supplied to the underwater releasing unit 14 to effect releasing of supercooled state in the underwater releasing unit 14.

When a part of the supercooled state is released, supercooling releasing proceeds with adhered or separated ice as seed ice, so that further inducing of supercooling release is not necessary. Therefore, after finishing inducement, the bypass line 16 is shut down and cold water is supplied to the sub-flow line 13 from the ice thermal storage tank 19.

With the ice making system described above, complete releasing of residual supercooled water after underwater supercooling release can be achieved, so freezing and clogging of flow passage in the process of transfer of supercooled water to the ice thermal storage tank can be prevented, and also freezing and clogging in the flow passage from the ice thermal storage tank to the supercooler, particularly in the pipe coduit in the supercooler can be prevented because there exists no residual supercooled water in the ice thermal storage tank due to said complete supercooling release.

Complete releasing of residual supercooled water accompanying ice nuclei can be achieved in the erect, cylindrical container, in which supercooling release is enhanced through the increase of contact of the supercooled water with ice nuclei owing to vortex flow or spiraling flow, and even if generated ice nuclei adhere to the wall, they are not consolidated but separated from the wall and gather toward the center of the spiraling flow because of the large sectional area of the flow and large flow velocity near the wall owing to the vortex flow.

Furthermore, by providing the inducing unit, not only the supercooling release in the underwater releasing unit is enhanced but also the variation in the rate of supercooling can be dealt with.

Thus, with the ice making system, residual supercooled state can be released and the clogging in pipe conduit can be prevented with simple construction.

Next, with reference to FIG. 4, an example of the low temperature supply system using said ice making system will be explained.

Figure 4:
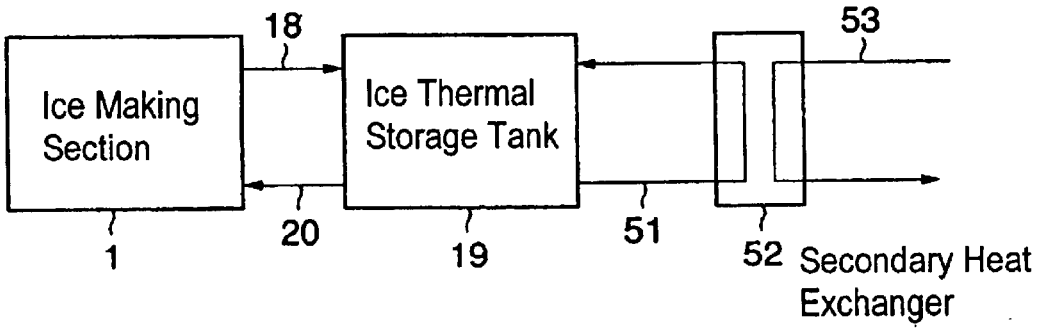
FIG. 4 is a representation showing an example of the low temperature water supply system using the ice making system shown in FIG. 2.

The low temperature water supply system shown in FIG. 4 is a so-called closed cycle system. The system comprises the ice making system having the ice making section 1 and ice thermal storage tank 19 explained in FIG. 2. A secondary heat exchanger 52 is connected to the ice thermal storage tank 19 via a circulation line 51. A circulation pump (not shown in the drawing) is provided in the circulation line 51.

To the secondary heat exchanger 52 is connected a load line 53 which is connected, for example, to factories and buildings, etc., and heat exchange is done between the circulation line 51 and load line 53 by the medium of the secondary heat exchanger 52, as mentioned later.

The ice water generated in the ice making section 1 is, as explained in FIG. 2, stored in the ice thermal storage tank 19 and at the same time supplied to the ice making section 1 through the water line 20. On the other hand, the cold water (ice water) stored in the ice thermal storage tank 19 is supplied to the secondary heat exchanger 52 by the circulation pump through the circulation line 51.

The load from factories, buildings, etc. in the shape of cooling medium such as water, air, and water solution, for example, is supplied to the secondary heat exchanger 52 through the load line 53. In the secondary heat exchanger 52, heat exchange is achieved between the cold water and load. As a result, the cold water is heated and the load is cooled. The heated cold water is again returned to the ice thermal storage tank 19 to be cooled.

On the other hand, the cooled load is sent to factories or buildings and used for air-conditioning, refrigeration, etc. through the medium, for example, of heat exchanger(not shown in the drawing) located in the factories or buildings, etc.

With the closed cycle system as mentioned above, the ice thermal storage tank 19 is not influenced by the variations of flow rate, etc. in the secondary side(load side).

The reason is that the condition of suction, etc. from the ice thermal storage tank 19 is constant, for the amount of water, etc in the ice thermal storage tank 19 does not change.

By unifying the ice making section 1 and ice thermal storage tank 19 in a unit, a low temperature water supply system can easily be constructed only by connecting the load line 53 and circulation line 51 to the secondary heat exchanger 52.

As a result, not only the construction time is shortened but also the renewal of the system is easy.

Further, the closed cycle system is suited in the case where it is not suitable to send the cold water in the ice thermal storage tank directly to the load side medium because of the possibility of leakage of the cold water to the load side medium, especially when an addition agent is added to the water in the ice thermal storage tank.

Next, with reference to FIG. 5, another example of low temperature water supply system using said ice making system will be explained.

Figure 5:
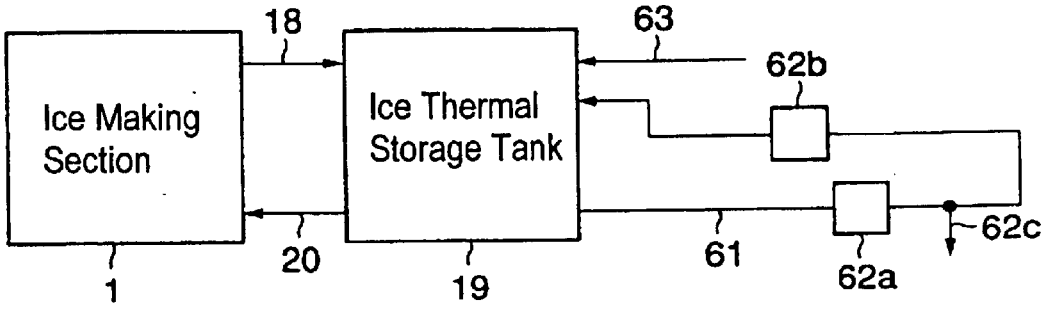
FIG. 5 is a representation showing another example of the low temperature water supply system using the ice making system shown in FIG. 2.

The low temperature water supply system shown in FIG. 5 is a so-called open cycle system. The system comprises the ice making system having the ice making section 1 and ice thermal storage tank 19 explained in FIG. 2. A supply line 61 is connected to the ice thermal storage tank 19. To the supply line 61 are connected heat exchangers 62*a* and 62*b* located, for example, in factories or buildings, etc. The supply line 61 also provided with a cold water supply part 62*c*.

Although two heat exchangers 62*a* and 62*b* are shown in FIG. 5, it is suitable to provide more than one heat exchanger as necessary. Also more than one cold water supply part 62*c* may be provided as necessary.

The ice water generated in the ice making section 1 is, as explained in FIG. 2, stored in the ice thermal storage tank 19 and supplied at the same time to the ice making section 1 through the water line 20. On the other hand, the cold water (ice water) stored in the ice thermal storage tank 19 is supplied by the circulation pump through the supply line 61 to the heat exchangers 62*a* and 62*b*, where heat exchange is achieved between the cold water and the load (cooling medium such as water, air, and water solution, for example), and air conditioning, refrigeration, etc. are performed by the cooling medium. Further, cold water can be supplied directly to factories or buildings to be directly utilized therein.

When said direct utilization of the cold water is done, the cold water stored in the ice thermal storage tank 19 decreases. Therefore, a water supply line (water supply system) 63 is connected to the ice thermal storage tank 19 and water is supplied to the ice thermal storage tank 19 through the water supply line 63 to compensate the decrease of the cold water.

In the case of the open cycle as mentioned above, the secondary heat exchanger is not needed, so that not only thermal efficiency is increased but direct utilization of cold water is possible in the secondary side(load side) of factories or buildings, etc.

INDUSTRIAL APPLICABILITY

As has been described in the foregoing, according to the present invention, when the water or water solution in a ice thermal storage tank is supercooled through a supercooler and the supercooled water is accommodated in a vessel to be released from the supercooled state continuously under water for making ice, clogging of the downstream flow passage caused by residual supercooled water can be prevented by achieving complete supercooling release reliably without leaving supercooled water. Further, by using the ice making system according to the present invention, easy construction of low temperature water supply system is possible.

What is claimed is:

1. A method of making ice by underwater supercooling release by supplying supercooled water to a closed vessel and also supplying through a sub-flow line sub-flow water containing seed ice to said closed vessel and releasing the supercooled state of said supercooled water under water, wherein are provided a first step for generating vortex flow spiraling in an erect, cylindrical container by spouting from the bottom part of said container a mixture containing residual supercooled water after said supercooling release and the ice nuclei generated by said releasing, and a second step for achieving supercooling release of said residual supercooled water by increasing the frequency of contact between said residual supercooled water and said ice nuclei through the agitation of said mixture caused by said vortex flow, which continues until the flow is pushed out from the outlet provided in the upper portion of said erect, cylindrical container.

2. The method of making ice by underwater supercooling release according to claim 1, wherein said erect, cylindrical container is connected to said closed vessel with a bypass flow passage, and a third step is provided for freshly generating ice nuclei in said residual supercooled water through an ice nuclei generating means attached to said bypass flow passage and circulating them to said closed vessel.

3. A system for making ice by underwater supercooling release by supplying supercooled water to a closed vessel and also supplying through a sub-flow line sub-flow water containing seed ice to a closed vessel and releasing the supercooled state of said supercooled water under water, wherein an erect, cylindrical container is provided into which the mixture from said closed vessel containing residual supercooled water and generated ice nuclei is flowed from the bottom part thereof with predetermined velocity in the direction tangential to the circumference of the cylindrical container to generate a spiraling flow therein, and an outlet, which also serves as air bleeder, for discharging nuclei is provided in the upper portion of the erect, cylindrical container.

4. The system for making ice by underwater supercooling release according to claim 3, wherein said erect, cylindrical container has a conically shaped outlet forming an outlet and air bleeder in the upper portion thereof, and the volume of the erect, cylindrical container is variable in accordance with the rate of supercooling of said residual supercooled water.

5. The system for making ice by underwater supercooling release according to claim 3, wherein a bypass passage is provided between said erect, cylindrical container and said closed vessel, and an inducing mechanism is located in said bypass passage for enhancing supercooling release.

6. The system for making ice by underwater supercooling release according to claim 5, wherein said inducing mechanism is provided with an automatic throttle valve mechanism for generating rapid pressure fluctuation of the supercooled water circulated through said bypass passage.

7. The system for making ice by underwater supercooling release according to any one of claim 3, 4, 5, or 6, wherein an ice thermal storage tank is provided for storing said generated ice.

8. A low temperature water supply system comprising the ice making system of claim 7, a circulation line connected to said ice thermal storage tank for circulating water, and a secondary heat exchanger or exchangers connected to the circulation line, a load or loads being connected to said secondary heat exchanger or exchangers.

9. A low temperature water supply system comprising the ice making system of claim 7, a feed line of cold water connected to said ice thermal storage tank, and a water supply mechanism for supplying water to said ice thermal storage tank, a load or loads being connected to said feed line of cold water.

* * * * *